US009518581B2

(12) United States Patent
Nakagawa

(10) Patent No.: US 9,518,581 B2
(45) Date of Patent: Dec. 13, 2016

(54) VANE PUMP INCLUDING SHAFT FITTING CONCAVE NOT TO BE PENETRATED

(71) Applicant: Satoshi Nakagawa, Tokyo (JP)

(72) Inventor: Satoshi Nakagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/409,402

(22) PCT Filed: Sep. 28, 2012

(86) PCT No.: PCT/JP2012/075169
§ 371 (c)(1),
(2) Date: Dec. 18, 2014

(87) PCT Pub. No.: WO2014/049853
PCT Pub. Date: Apr. 3, 2014

(65) Prior Publication Data

US 2015/0330389 A1 Nov. 19, 2015

(51) Int. Cl.
*F03C 2/00* (2006.01)
*F03C 4/00* (2006.01)
(Continued)

(52) U.S. Cl.
CPC ..... *F04C 18/3441* (2013.01); *F01C 21/0809* (2013.01); *F01C 21/108* (2013.01); *F04C 2/344* (2013.01); *F04C 2/3441* (2013.01); *F04C 15/0076* (2013.01); *F04C 18/344* (2013.01); *F04C 27/005* (2013.01); *F04C 29/0078* (2013.01); *F04C 2240/20* (2013.01); *F04C 2240/60* (2013.01)

(58) Field of Classification Search
CPC ..... F04C 2/344; F04C 2/3441; F04C 2/3446; F04C 18/344; F04C 18/3441; F04C 18/3446; F04C 15/0076; F04C 15/0023; F04C 2240/60; F04C 2250/10; F04C 2250/101; F04C 2250/102; F01C 21/0809; F01C 21/10; F01C 21/108
USPC ..... 418/133, 259, 266–268
See application file for complete search history.

(56) References Cited

U.S. PATENT DOCUMENTS

2006/0099099 A1* 5/2006 Amano ..... F04C 21/0809 418/259
2006/0099102 A1 5/2006 Kato et al.
(Continued)

FOREIGN PATENT DOCUMENTS

JP 58-183990 U 12/1983
JP 2006-48203 A 2/2006
(Continued)

*Primary Examiner* — Theresa Trieu
(74) *Attorney, Agent, or Firm* — Birch, Stewart, Kolasch & Birch, LLP

(57) ABSTRACT

A shaft is fitted in a shaft fitting concave part to provide a structure such that no shaft penetrates through a rotor, so that an inner space (shaft fitting concave part, and hollow parts) and an outer space (pump chamber) of the rotor are made independent. The inner space of the rotor is communicated with outside to be at a low pressure, and the outer space is at a high pressure due to gas compression, and an upper surface of the rotor slides on an inner wall surface of a rotor housing part with pressed against this inner wall surface by a pressure difference.

7 Claims, 6 Drawing Sheets

(51) Int. Cl.

| | |
|---|---|
| ***F04C 2/00*** | (2006.01) |
| ***F04C 18/344*** | (2006.01) |
| ***F04C 2/344*** | (2006.01) |
| ***F01C 21/08*** | (2006.01) |
| ***F01C 21/10*** | (2006.01) |
| ***F04C 15/00*** | (2006.01) |
| ***F04C 27/00*** | (2006.01) |
| ***F04C 29/00*** | (2006.01) |

(56) References Cited

U.S. PATENT DOCUMENTS

| | | | | |
|---|---|---|---|---|
| 2011/0123372 | A1* | 5/2011 | Itoh | F04C 21/0809 418/159 |
| 2011/0138885 | A1 | 6/2011 | Kobayashi et al. | |
| 2012/0047999 | A1* | 3/2012 | Itoh | F02M 25/0818 73/168 |

FOREIGN PATENT DOCUMENTS

| | | | |
|---|---|---|---|
| JP | 2006-132430 | A | 5/2006 |
| JP | 2008-231955 | A | 10/2008 |
| JP | 2008-240652 | A | 10/2008 |
| JP | 2011-117380 | A | 6/2011 |
| JP | 2011-122541 | A | 6/2011 |

* cited by examiner

VANE PUMP INCLUDING SHAFT FITTING CONCAVE NOT TO BE PENETRATED

TECHNICAL FIELD

The present invention relates to a vane pump that compresses gas by rotationally driving a rotor with vanes.

BACKGROUND ART

Conventionally, as a method of diagnosing leakage in piping of evaporated fuel, there has been established a method of pressurizing the piping by an air pump after sealing the piping, and diagnosing a leakage amount in the piping based on a pressure variation in the piping or a load to the air pump at that time. Then, as the air pump to be used for the diagnosis, a vane pump as one of positive displacement pumps is popular.

Major components of the vane pump are a cylindrical rotor, thin plate vanes, and a cylindrical housing that houses them. The rotor is installed at a position eccentric from the center of the housing, and the vanes are installed slidably in slits provided on outer peripheral portions of the rotor. With rotation of the rotor, the vanes slide in a radial direction inside the slits, so that the vanes rotate while maintaining a close contact state between an inner wall surface of the housing and end portions of the vanes. When the vanes rotate with keeping the close contact with the housing wall surface, there is generated a sealed space which is surrounded by the rotor, the housing, and the vanes; a volume of the space changes continuously with the rotation of the rotor, and thus a function as the air pump is established. A gas is sent out in such a manner that the space is connected to an intake port at a volume expanding timing, and connected to a discharge port at a volume reducing timing.

The rotor of the vane pump is rotationally driven by a motor, and the rotor and the motor are connected to each other such that a motor shaft is inserted into a hole bored in a center part of the rotor. In order to absorb axial deflection of the motor shaft, a variation in component dimensions, and a dimensional variation thereof due to temperature changes, etc., a certain clearance is necessary between the motor shaft and the rotor hole; however, due to the provision of the clearance, the rotor cannot be completely fixed, which causes a rotor vibration. In particular, under a high-load condition, there is a matter such that the rotor vibrates extremely to generate abnormal sound and also reduce a flow characteristic thereof.

In addition, because a characteristic of the air pump strongly influences accuracy of the air pump-based diagnosis for the leakage in the piping, highly accurate dimensions are required for the vane pump to be used as the air pump. As a result, there are problems such that cost of the components increases, and that the diagnostic accuracy reduces because of a variation in the characteristic due to abrasion associated with usage.

Accordingly, in Patent Documents 1 and 2, for example, it is adapted that since a rotor is inclined to an axial direction of a motor shaft, during rotation of a motor, vibrations of the rotor are suppressed by setting the rotor in a state that an outer edge part of the rotor is in sliding contact with a housing. Further, according to Patent Document 3, for example, it is adapted that since slits that house vanes are inclined to an axial direction of a motor shaft, during rotation of a motor, vibrations of a rotor are suppressed by setting the rotor in a state that the vanes move in the axial direction by force received from the gas so that the vanes are pressed against a housing wall surface.

RELATED ART DOCUMENTS

Patent Documents

Patent Document 1: Japanese Patent Application Laid-open No. 2011-117380

Patent Document 2: Japanese Patent Application Laid-open No. 2011-122541

Patent Document 3: Japanese Patent Application Laid-open No. 2006-132430

SUMMARY OF THE INVENTION

Problems to be Solved by the Invention

According to the vane pumps in Patent Documents 1 to 3, the vane pump is configured such that the rotor or slits are inclined to the motor shaft; thus, there is a problem such that production thereof is difficult, which causes increase in cost. Further, in the case of the configuration in which the slits are inclined, there is also a problem such that sliding resistance increases due to increase in contact area between the slits and the vanes, so that the gas can easily leak from gaps between the end portions of the vanes and the housing wall surface.

The present invention has been made to solve the foregoing problems, and an object of the invention is to provide a vane pump that suppresses vibrations of a rotor in a simple structure and that stabilizes a rotational operation of the rotor.

Means for Solving the Problems

A vane pump according to the present invention includes: a housing in which there are formed a cylindrical rotor housing part, an intake port and a discharge port that allow the rotor housing part to communicate with outside, and a shaft through-hole through which a motor shaft is penetrated to the rotor housing part; a cylindrical rotor that is housed in the rotor housing part eccentrically to a center of the rotor housing part and that rotates integrally with the motor shaft; and vanes that are installed in the rotor, movable outward in a radial direction by receiving rotation force of the rotor, and rotates in sliding contact with an inner peripheral surface of the rotor housing part, and the rotor has a shaft fitting concave part in which an end portion of the motor shaft that penetrates through the shaft through-hole is fitted, and the shaft fitting concave part is formed on a surface of the rotor that faces the motor shaft, not permitting penetration to the opposite side of the surface of the rotor that faces the motor shaft.

Effect of the Invention

According to the present invention, because there is provided a structure in which the motor shaft does not penetrate through the rotor, inner and outer spaces of the rotor can be made independent from each other. Further, by making the inner side of the rotor communicate with the low pressure side of the housing outer part, a pressure difference is generated between inner and outer spaces of the rotor, and thus the rotor can slide with pressed against an inner wall surface of the rotor housing part by pressure of a compressed air outside the rotor. Therefore, it is possible to provide a vane pump capable of suppressing vibrations of the rotor and stabilizing a rotational operation of the rotor.

MODES FOR CARRYING OUT THE INVENTION

In the following, in order to describe the present invention in more detail, embodiments for carrying out the invention will be described with reference to the accompanying drawings.

Embodiment 1

Figure 1:
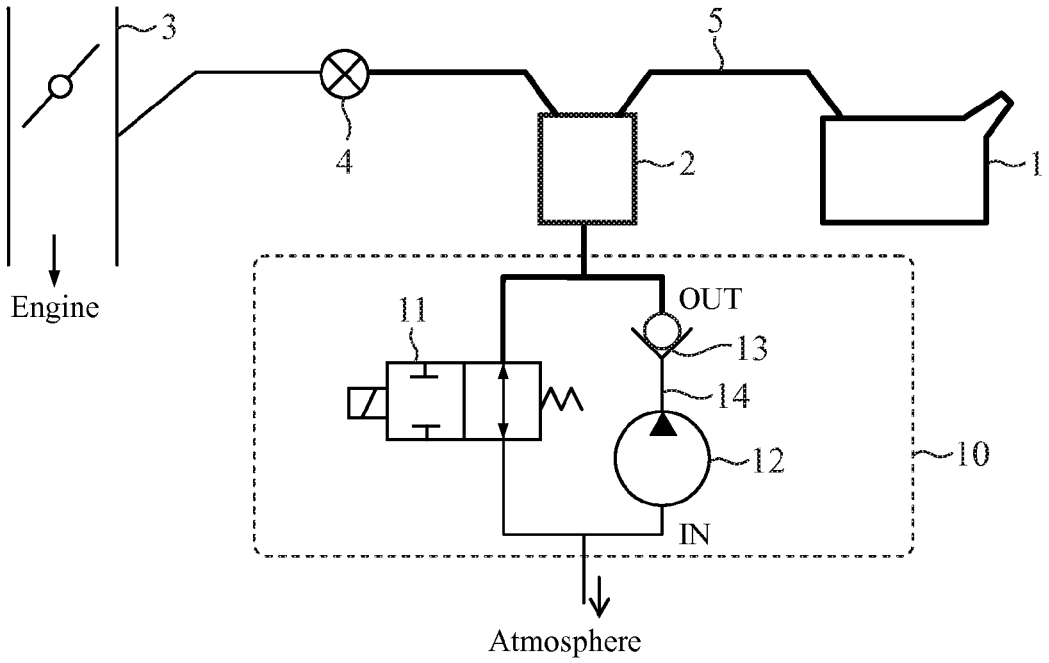
FIG. 1 is a diagram showing a configuration of an airtightness diagnostic device of an evaporative emission control system that uses a vane pump according to Embodiment 1 of the present invention.

An evaporative emission control system shown in FIG. 1 is configured by a fuel tank 1, a canister 2 that adsorbs a fuel evaporated in the fuel tank 1 and that temporarily stores the fuel, an inlet manifold 3 that introduces into an engine the evaporated fuel recovered in the canister 2, and an NC (Normally Close) type purge solenoid valve 4 that controls a flow rate of the evaporated fuel. An airtightness diagnostic device 10 according to the present Embodiment 1 is a product that is used to detect leakage in a piping system 5 shown by a thick line in FIG. 1, and includes an NO (Normally Open) type canister vent solenoid valve 11 that closes a pipe that allows the canister 2 to communicate with the atmosphere, a vane pump 12 that discharges a compressed air from the atmosphere to the canister 2 and pressurizes the piping system 5, and a check valve 13 that is provided on a discharge side of the vane pump 12 and that closes a pipe 14 between the piping system 5 and the vane pump 12.

Additionally, in FIG. 1, there is provided a configuration in which the leakage is detected by pressuring the piping system 5 using the vane pump 12. Reversely, there may also be provided a configuration in which the leakage is detected by decompressing the piping system 5 using the vane pump 12.

Figure 2:
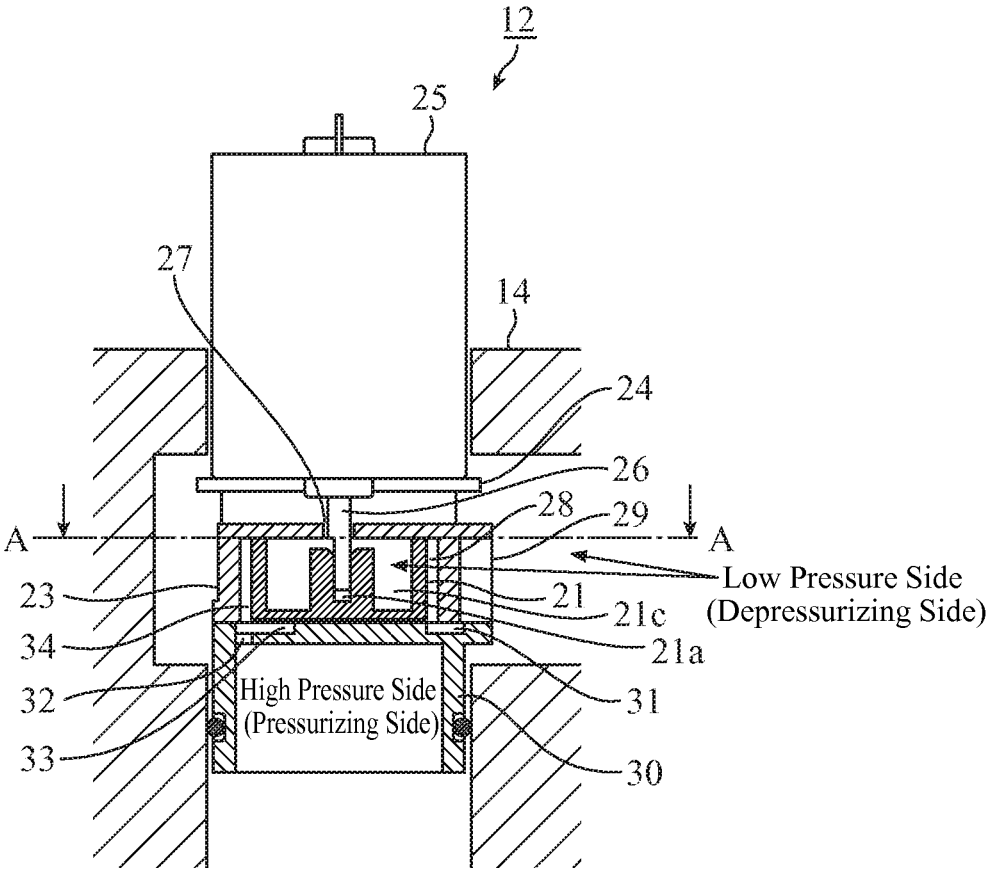
FIG. 2 is a sectional view showing a configuration of the vane pump according to Embodiment 1.
Figure 3:
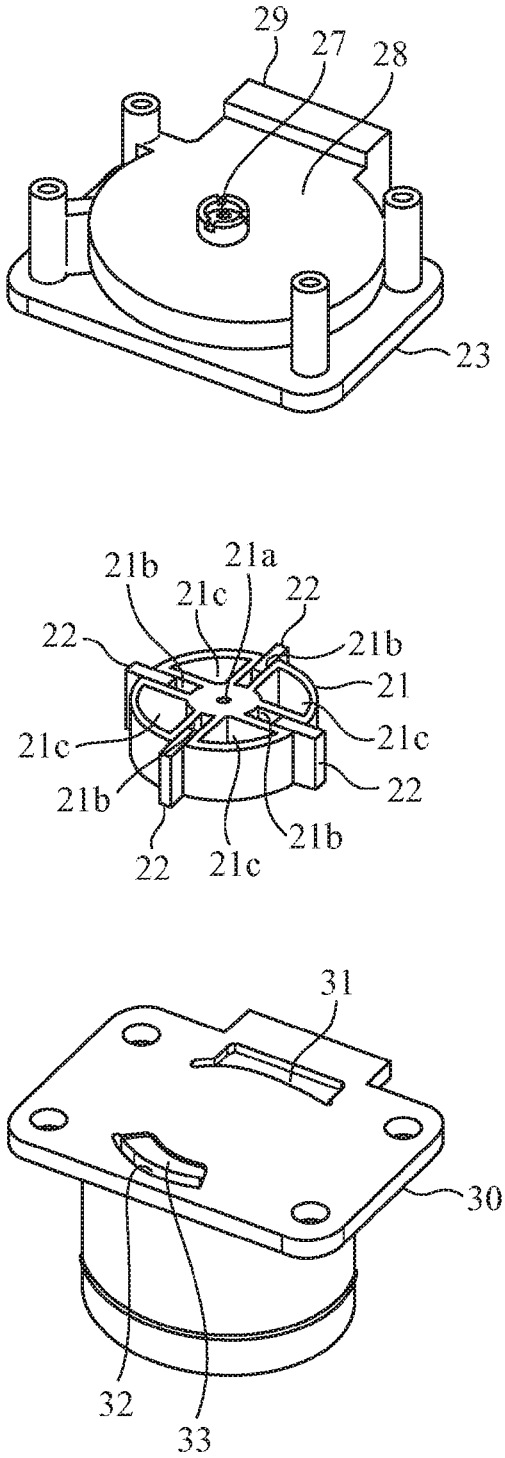
FIG. 3 is an exploded perspective view showing the configuration of the vane pump according to Embodiment 1.

FIG. 2 shows a sectional view of the vane pump 12, and is an example in which it is installed in the pipe 14 that connects between the atmosphere side and the canister 2. FIG. 3 shows an exploded perspective view of the vane pump 12. Note that in FIG. 3, a metal plate 24 and a motor 25 is not shown.

The vane pump 12 is configured by a rotor 21 in a cylindrical shape, a plurality of vanes 22 in thin plate shapes, a first housing 23 made of a resin that houses the rotor 21 and the plurality of vanes 22, a second housing 30 made of a resin that closes a bottom surface side of the first housing 23, and the motor 25 that is fixed to the first housing 23 across the metal plate 24 and that rotationally drives the rotor 21. The metal plate 24 on which the motor 25 is installed, the first housing 23, and the second housing 30 are fastened with screws (not shown) to be integrated.

In the first housing 23, there are formed a shaft through-hole 27 through which a shaft 26 of the motor 25 is penetrated, a rotor housing part 28 that houses the rotor 21, and an intake port 29 that sucks air by communicating with the atmosphere side. In the second housing 30, there are formed an intake groove 31 that makes the intake port 29 and the rotor housing part 28 communicate with each other, a discharge port 32 that communicates with the piping system 5 via the check valve 13 and discharges a compressed air from the rotor housing part 28, and a pressure introduction groove 33 that introduces the compressed air near the discharge port 32 thereinto.

In the rotor 21, there are formed a shaft fitting concave part 21*a* in which an end portion of the shaft 26 is fitted by insertion, a plurality of slits 21*b* that house slidably the plurality of vanes 22, and a plurality of hollow parts 21*c* for lightening the rotor 21. It is noted that the shaft fitting concave part 21*a* is a concave part that is formed on a surface of the rotor 21 that faces the motor 25 (an end surface at an upper side of the rotor 21 in the shown example), not permitting penetration thereof to the opposite side (an end surface at a lower side of the rotor 21 in the shown example).

Figure 4:
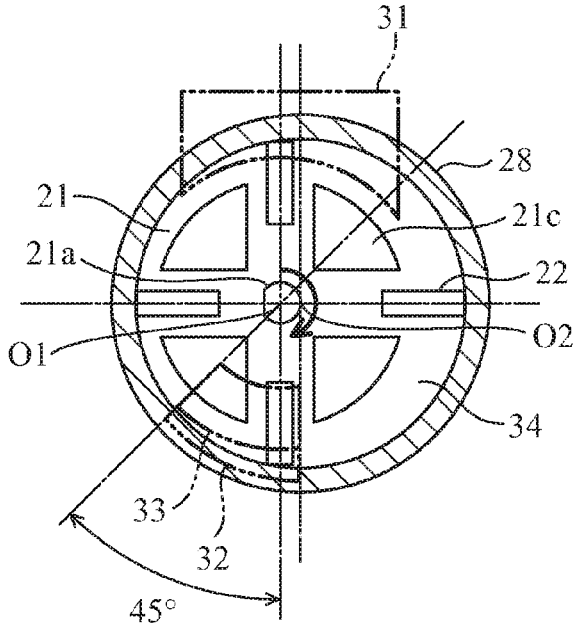
FIG. 4 is a sectional view of the vane pump taken along a line AA in FIG. 2 according to Embodiment 1.
Figure 5:
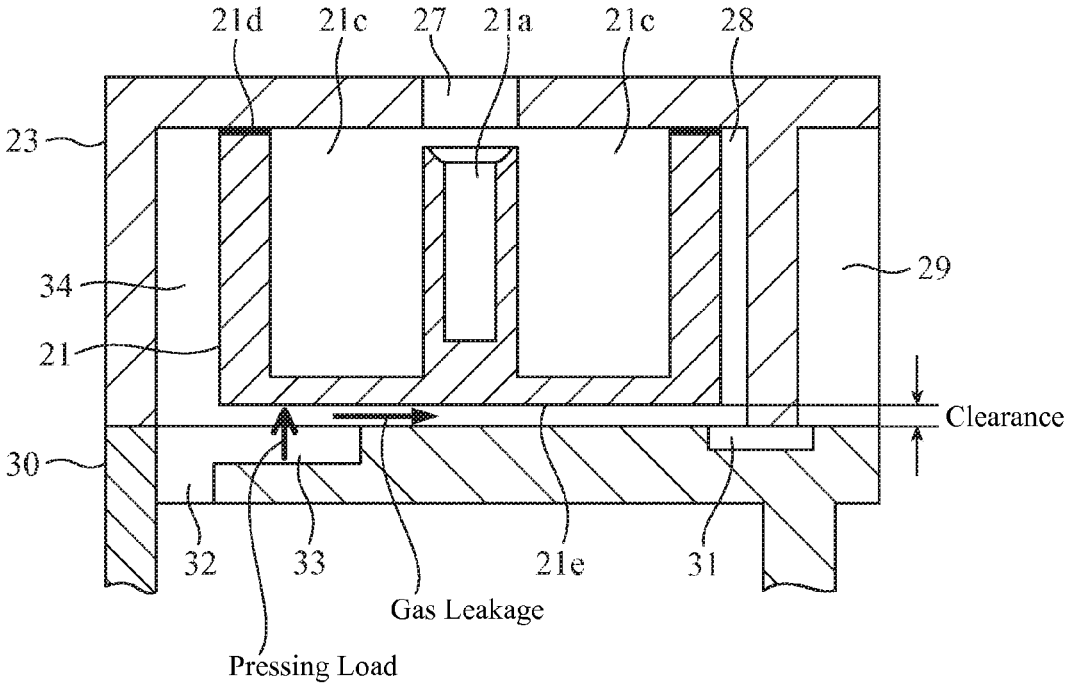
FIG. 5 is an enlarged sectional view of a rotor of the vane pump and its peripheral portion according to Embodiment 1.

FIG. 4 is a sectional view of the vane pump 12 taken along a line AA in FIG. 2. FIG. 5 is an enlarged sectional view of the rotor 21 and its peripheral portion.

The rotor 21 is housed in the rotor housing part 28 in a state eccentric to the rotor housing part 28. An axial center O1 of the rotor 21 and an axial center O2 of the rotor housing part 28 do not coincide with each other to be in a mutually deviated positional relationship. When the motor 25 is operated to rotationally drive the rotor 21, each vane 22 receives centrifugal force generated by rotation of the rotor 21 to be slid outward in a radial direction of the rotor 21, and rotated while an end portion of each vane 22 is in sliding contact with an inner wall surface of the rotor housing part 28. Because the rotor 21 and the rotor housing part 28 are disposed at eccentric positions, the volume in a pump chamber 34 that is surrounded by the inner wall surface of the rotor housing part 28, the outer peripheral surface of the rotor 21, and the vanes 22 increases or decreases according to the rotation of the rotor 21. That is, when the pump chamber 34 is in a position where the pump chamber 34 is connected to the intake groove 31, the volume increases according to the rotation of the rotor 21, and as the pump chamber 34 further approaches a position to be connected to the discharge port 32, the volume gradually decreases. Therefore, the gas passed through the intake groove 31 from the intake port 29 to be flown into the pump chamber 34 is compressed according to the rotation of the rotor 21, and thereafter discharged from the discharge port 32.

It is noted that FIG. 4 shows a configuration example in which the four vanes 22 are provided. In this case, an end position of the discharge port 32 is set at a position of 45° from the axial center O1 of the rotor 21.

As described previously, in order to absorb axial deflection of the shaft 26, a variation in component dimensions, and a dimensional variation due to temperature changes etc., there is provided a certain clearance between the shaft 26 and the shaft fitting concave part 21*a*. For this reason, the rotor 21 vibrates in rotational driving of the motor 25. Accordingly, in the present Embodiment 1, instead of fixing the rotor 21 to the shaft 26, a pressure difference is generated between inner and outer spaces of the rotor 21 during operation of the vane pump 12, such that a pressing load to the inner wall surface of the rotor housing part 28 is applied to the rotor 21. Since the rotor 21 rotates in a state pressed against the inner wall surface of the rotor housing part 28 due to a constant load, an occurrence of vibrations during the rotation is suppressed, so that a rotational operation of the rotor 21 is stabilized.

A generation source of a pressure on a high pressure side applied to the rotor 21 is an internal pressure of the pump chamber 34 generated by the rotation of the rotor 21. On the other hand, a pressure on a low pressure side utilizes a pressure on an intake side. In the case of using the vane pump 12 as a pressurizing pump, the pressure on the intake side is an atmospheric pressure, and in the case of using the vane pump 12 as a depressurizing pump, the pressure on the intake side is a vessel pressure on a depressurizing side.

In order that the pressure on the high pressure side generated in the pump chamber 34 is effectively exerted on the rotor 21, the inner and outer ones of the rotor 21 are spatially separated.

As a separating method, (1) a shaft fitting concave part 21*a* of the rotor 21 is configured so as not to permit penetration therethrough. In a case where the shaft fitting concave part 21*a* is penetrated from an upper surface 21*d* of the rotor 21 to a lower surface 21*e* of the rotor 21, the atmospheric air around the vane pump 12 flows from the shaft fitting concave part 21*a* into the space at the lower surface 21*e* side via the shaft through-hole 27. On the other hand, as shown in FIGS. 2 and 5, by not permitting the penetration through the shaft fitting concave part 21*a*, the atmospheric air around the vane pump 12 flows into only the shaft fitting concave part 21*a* and the hollow parts 21*c*, that is, only the inner space of the rotor 21, and a high pressure which is the same as that in the pump chamber 34 is maintained in the outer space of the rotor 21. Consequently, a pressing load is generated from the lower surface 21*e* side of the rotor 21 to the upper surface 21*d* side of the rotor 21.

In order to effectively apply the generated pressing load to the rotor 21, on an inner wall surface of the second housing 30, a pressure introduction groove 33 is formed at a position to be communicated with the discharge port 32 and to face the rotor 21. A part of the high-pressure compressed air discharged from the pump chamber 34 to the discharge port 32 is introduced to the pressure introduction groove 33, and applies a pressure to the lower surface 21*e* of the rotor 21.

Note that a depth of the pressure introduction groove 33 in the shown example is illustrated in an exaggeratedly enlarged manner, and is different from that of the actual scale.

In addition, as a separating method, (2) surface roughness of the upper surface 21*d* of the rotor 21 is enhanced to provide a smooth surface. Accordingly, the sealing property between the upper surface 21*d* and the inner wall surface of the rotor housing part 28 is improved, so that the compressed air in the pump chamber 34 becomes hard to leak to the hollow part 21*c* side, thereby securing the airtightness. Further, the sliding resistance between the upper surface 21*d* and the inner wall surface of the rotor housing part 28 is reduced, so that the rotational operation of the rotor 21 is stabilized.

Additionally, although in FIG. 5, the upper surface 21*d* of the rotor 21 is provided with the smooth surface, oppositely, the inner wall surface of the rotor housing part 28 may be provided with the smooth surface, or each of the upper surface 21*d* and the inner wall surface of the rotor housing part 28 may be provided with the smooth surface.

Based on the above (1) and (2), passage of the gas between the inner and outer spaces of the rotor 21 is prevented to thus maintain the generated pressure difference.

Moreover, in order that the internal pressure of the pump chamber 34 becomes always higher than the pressure of the space on the discharge side, the opening area of the discharge port 32 is made smaller than the opening area of the intake port 29 to thus narrow the path of the gas, thereby increasing intentionally the internal pressure of the pump chamber 34. In this manner, an effective pressing load can be generated from immediately after driving the motor 25. Further, the pressing load of a stable pressure can be applied to the rotor 21 without depending on the pressure in the space on the discharge side (the internal pressure of the piping system 5 in the case of FIG. 1).

On the other hand, because a gas leakage amount from a clearance between the rotor 21 and the inner wall surface of the rotor housing part 28 strongly influences the characteristic of the vane pump 12, the characteristic can also be stabilized by stabilizing the leakage amount from the clearance. In the case of the vane pump 12 in the present Embodiment 1, because the rotor 21 is pressed against the first housing 23 side based on the above (1) and (2), it is assumed that the clearance is always generated between the lower surface 21*e* of the rotor 21 and the inner wall surface of the second housing 30. Accordingly, by implementing the measure against the leakage from the clearance between the lower surface 21*e* and the inner wall surface of the second housing 30, the characteristic of the vane pump 12 can be stabilized.

Figure 6:
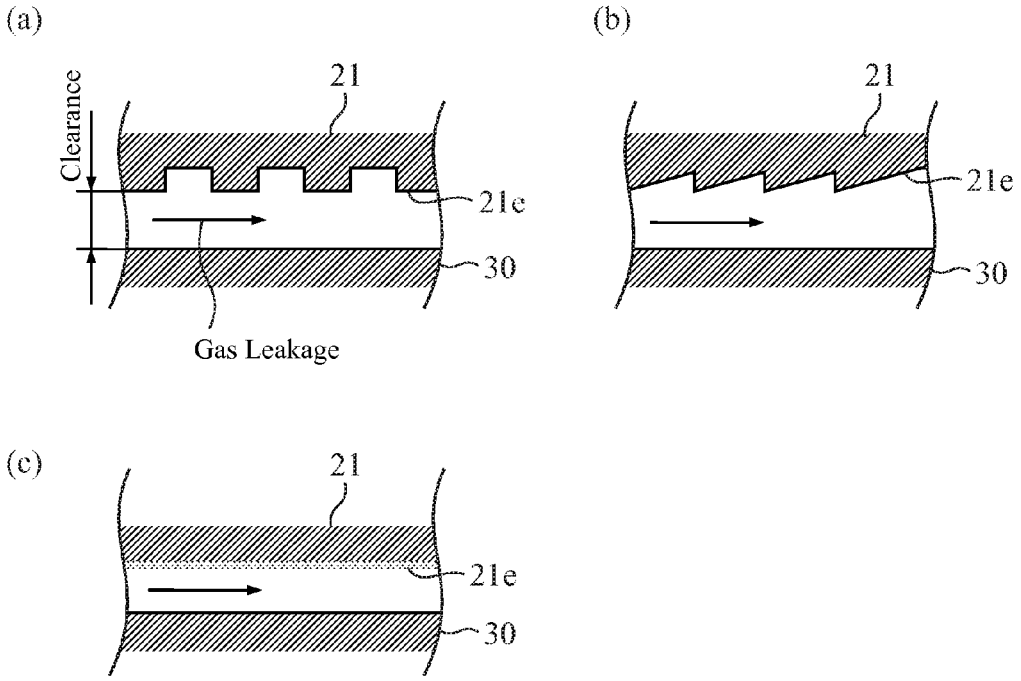
FIG. 6 is an enlarged view of a clearance portion between a lower surface of the rotor and an inner wall surface of a housing of the vane pump according to Embodiment 1.

FIG. 6 is an enlarged view of a clearance portion between the lower surface 21*e* of the rotor 21 and the inner wall surface of the second housing 30. Inside the rotor housing part 28, the discharge port 32 is at a high pressure, and the intake groove 31 side is at a low pressure; therefore, the gas can easily flow in an arrow direction through the clearance. Accordingly, by intentionally disturbing the flow in the clearance portion, an airflow resistance is increased to thereby reduce the leakage amount, and the variation in the leakage amount at the time when the clearance varies is reduced to thereby suppress the variation in the characteristic. In FIG. 6(*a*), a concave-convex shape with vertical level differences is formed in a flow direction of the gas leakage, on the lower surface 21*e* of the rotor 21. In FIG. 6(*b*), a serrated concave-convex shape is provided. In FIG. 6(*c*), the lower surface 21*e* is provided with a rough surface by satin processing or the like.

Additionally, although in FIG. 6, the lower surface 21*e* of the rotor 21 is provided with the concave-convex or rough surface, oppositely, the inner wall surface of the second housing 30 may be provided with the concave-convex or rough surface, or each of the lower surface 21*e* and the inner wall surface of the second housing 30 may be provided with the concave-convex or rough surface.

Figure 7:
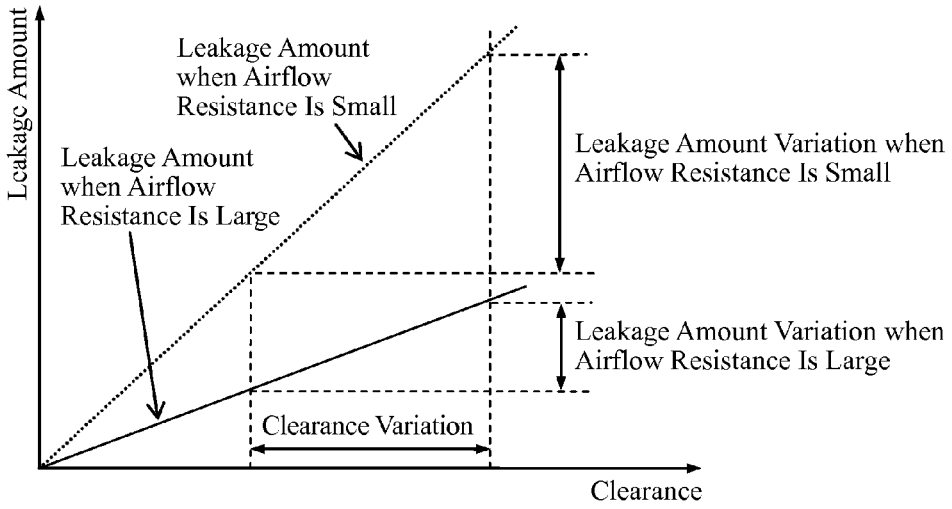
FIG. 7 is a graph showing a relationship of a clearance to an airflow resistance and a leakage amount in the vane pump according to Embodiment 1.

FIG. 7 is a graph showing a relationship of the clearance to the airflow resistance and the leakage amount. A vertical axis of the graph shows a size of the clearance, a lateral axis shows the leakage amount, a solid line shows the leakage amount in a case where the concave-convex shape is formed on the lower surface 21*e* (large airflow resistance), and a dotted line shows the leakage amount in a case where the lower surface 21*e* is flat (small airflow resistance). As shown in the graph, the leakage amount can be reduced by increasing the airflow resistance. Also, when the clearance varies, the variation of the leakage amount in the large airflow resistance can be reduced as compared with that of the leakage amount in the small airflow resistance.

The variation of the clearance occurs due to, for example, a variation in component dimensions in the manufacture, and operational abrasion etc. However, by reducing an influence of the clearance variation based on the configuration in FIG. 6, a management in the component dimensions becomes simple, which leads to cost reduction. Further, the durability improves because a characteristic variation due to operational abrasion becomes small.

Additionally, as shown in FIG. 5, the pressure (the pressing load) of the pressure introduction groove 33 is not uniformly exerted on the whole surface of the lower surface 21*e* of the rotor 21, but exerted on a part of the surface that faces the pressure introduction groove 33; however, with the above configuration, because the pressing load sufficiently larger than the own weight of the rotor 21 is stably applied to the surface, a stable rotational operation thereof is possible without inclination.

Incidentally, as one of causes of the vibration of the rotor 21, there is considered the influence of a variation in the pressure state of the rotor housing part 28 (vibration at the time of pressurizing or depressurizing from the atmospheric pressure to a target pressure at which the diagnosis of leakage in the piping is performed). However, by narrowing the discharge side more than the intake side, the internal pressure of the rotor housing part 28 is stabilized, and prevention of the vibration becomes possible.

As described above, according to Embodiment 1, the vane pump 12 includes: housings (first housing 23 and second housing 30) in which there are formed the cylindrical rotor housing part 28, the intake port 29 and discharge port 32 that allow the rotor housing part 28 to communicate with the outside, and the shaft through-hole 27 through which the shaft 26 of the motor 25 is penetrated to the rotor housing part 28; the cylindrical rotor 21 that is housed in the rotor housing part 28 eccentrically to the axial center O1 of the rotor housing part 28 and that rotates integrally with the shaft 26 of the motor 25; and the vanes 22 that are installed in the rotor 21, movable outward in a radial direction by receiving rotation force of the rotor 21, and rotates in sliding contact with an inner peripheral surface of the rotor housing part 28, and the rotor 21 is configured to have the shaft fitting concave part 21*a* in which an end portion of the shaft 26 that penetrates through the shaft through-hole 27 is fitted, and that the shaft fitting concave part 21*a* is formed on the surface of the rotor 21 that faces the shaft 26, not permitting penetration to the opposite side of the surface of the rotor 21 that faces the shaft 26. By providing a structure in which the shaft 26 does not penetrate through the rotor 21, the inner and outer spaces of the rotor 21 are made independent, and allowing the inner space of the rotor 21 to communicate with the low pressure side outside the housing, the pressure difference is generated between the inner and outer spaces during the rotation of the rotor 21, and by receiving the pressure of the compressed air, the rotor 21 comes to slide in a state where the upper surface 21*d* is pressed against the inner wall surface of the rotor housing part 28. Therefore, the vibration of the rotor 21 can be suppressed with a simple structure, and it becomes possible to stabilize the rotational operation of the rotor 21.

In addition, according to Embodiment 1, because the opening area of the discharge port 32 is configured such that the opening area is smaller than the opening area of the intake port 29, the pressure difference can be generated in the inner and outer spaces of the rotor 21 from immediately after the rotational operation of the rotor 21, and the rotational operation of the rotor 21 can be stabilized from a start time.

Further, according to Embodiment 1, because either one or both of the upper surface 21*d* of the rotor 21 and the inner wall surface of the rotor housing part 28 that faces the upper surface 21*d* are provided with smooth surfaces, the rotational operation of the rotor 21 can be further stabilized.

Furthermore, according to Embodiment 1, the second housing 30 is configured such that the second housing 30 is communicated with the discharge port 32 and has the pressure introduction groove 33 at a position which faces the rotor 21. Therefore, the pressure on the high pressure side generated on the lower surface 21*e* of the rotor 21 can be easily applied to the rotor 21, and the rotational operation of the rotor 21 can be further stabilized.

Figure 8:
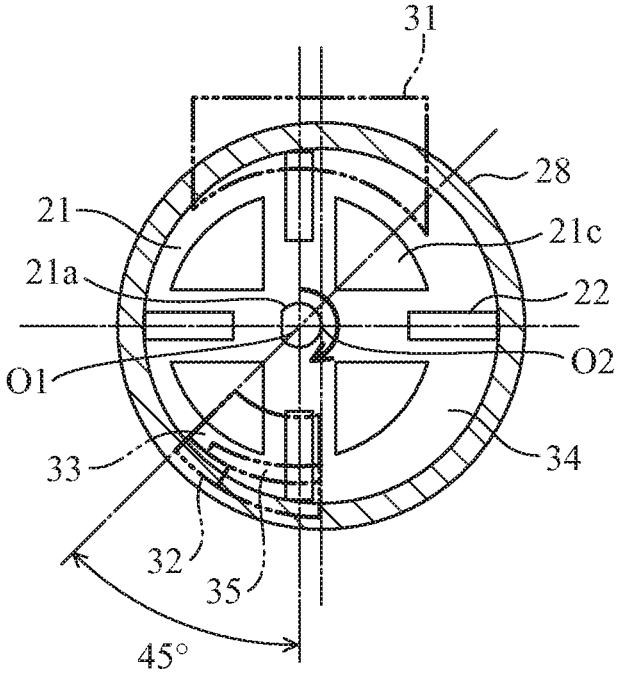
FIG. 8 is a sectional view showing a modification of the vane pump according to Embodiment 1.

It is noted that a peripheral structure of the pressure introduction groove 33 is not limited to the above illustrated example. For example, as shown in FIG. 8, when a partition plate 35 is formed between the pressure introduction groove 33 and the discharge port 32, the partition plate 35 serves as a support of the vanes 22. Therefore, the rotational operation of the vanes 22, and eventually, the rotational operation of the rotor 21 can be further stabilized.

Moreover, according to Embodiment 1, by pressing the upper surface 21*d* to the inner wall surface of the first housing 23 by the pressure difference between the inner and outer spaces of the rotor 21, the surface on which the clearance is generated between the rotor 21 and the housing can be determined as only the lower surface 21*e* side. Therefore, by forming the roughness or the like on one or both of the lower surface 21*e* of the rotor 21 on which the clearance is generated, and the inner wall surface of the second housing 30, the airflow resistance of the clearance portion is increased to thus reduce the leakage amount. Accordingly, the variation in the flow rate between individual units and the characteristic variation due to the operational abrasion can be suppressed.

Incidentally, in the above illustrated example, although the four vanes 22 are provided, the number is not limited to this, and an arbitrary number of the vanes 22 may be provided. Further, although the hollow parts 21*c* are formed in the rotor 21, there may be no hollow parts 21*c*.

Other than the above, in the present invention, within the range of the present invention, components of the embodiments can be arbitrarily modified, or the components of the embodiments can be arbitrarily omitted.

INDUSTRIAL APPLICABILITY

As described above, since the vane pump according to the present invention is configured such that the rotational operation of the rotor is stabilized to thus stabilize the flow characteristic, it is suitable for use in the air pump and the like of the airtightness diagnostic device that performs diagnosis of leakage in the piping of the evaporative emission control system.

DESCRIPTION OF REFERENCE NUMERALS

1: fuel tank
2: canister
3: inlet manifold
4: purge solenoid valve

5: piping system
10: airtightness diagnostic device
11: canister vent solenoid valve
12: vane pump
13: check valve
14: pipe
21: rotor
21*a*: shaft fitting concave part
21*b*: slit
21*c*: hollow part
22: vane
23: first housing
24: metal plate
25: motor
26: shaft
27: shaft through-hole
28: rotor housing part
29: intake port
30: second housing
31: intake groove
32: discharge port
33: pressure introduction groove
34: pump chamber
35: partition plate.

The invention claimed is:

1. A vane pump comprising:

a first housing having a rotor housing that houses a rotor, an intake port, and a shaft through-hole through which a motor shaft is penetrated to the rotor housing;

a second housing having a discharge port that allow the rotor housing to communicate with outside;

a cylindrical rotor that is housed in the rotor housing eccentrically to a center of the rotor housing and that rotates integrally with the motor shaft; and vanes that are installed in the rotor, movable outward in a radial direction by receiving rotation force of the rotor, and rotates in sliding contact with an inner peripheral surface of the rotor housing, wherein the rotor has a shaft fitting concave in which an end portion of the motor shaft that penetrates through the shaft through-hole is fitted, and the shaft fitting concave is formed on a surface of the rotor that faces the motor shaft, not permitting penetration to the opposite side of the surface of the rotor that faces the motor shaft.

2. The vane pump according to claim 1, wherein an opening area of the discharge port is smaller than that of the intake port.

3. The vane pump according to claim 1, wherein one or both of a surface on which the shaft fitting concave of the rotor is formed and a surface of the first housing that faces the surface on which the shaft fitting concave of the rotor is formed are smooth surfaces.

4. The vane pump according to claim 1, wherein the second housing is communicated with the discharge port and also has a groove at a position that faces the rotor.

5. The vane pump according to claim 1, wherein a concave-convex shape is formed on one or both of a surface opposite to the surface on which the shaft fitting concave of the rotor is formed, and a surface of the second housing that faces the opposite surface.

6. The vane pump according to claim 1, wherein a serrated concave-convex shape is formed on one or both of a surface opposite to the surface on which the shaft fitting concave of the rotor is formed, and a surface of the second housing that faces the opposite surface.

7. The vane pump according to claim 1, wherein one of or both of a surface opposite to the surface on which the shaft fitting concave of the rotor is formed and a surface of the second housing that faces the opposite surface are rough surfaces.

* * * * *